US008870717B2

(12) United States Patent
Pfitzer

(10) Patent No.: US 8,870,717 B2
(45) Date of Patent: Oct. 28, 2014

(54) EXERCISE DEVICE

(75) Inventor: Daniel Lee Pfitzer, Toledo, OH (US)

(73) Assignee: Fitness Stability Dynamics, LLC, Toledo, OH (US)

( * ) Notice: Subject to any disclaimer, the term of this patent is extended or adjusted under 35 U.S.C. 154(b) by 586 days.

(21) Appl. No.: 13/079,832

(22) Filed: Apr. 5, 2011

(65) Prior Publication Data

US 2011/0251030 A1 Oct. 13, 2011

Related U.S. Application Data

(60) Provisional application No. 61/321,535, filed on Apr. 7, 2010.

(51) Int. Cl.

| | |
|---|---|
| ***A63B 21/00*** | (2006.01) |
| ***A63B 23/035*** | (2006.01) |
| ***A63B 21/015*** | (2006.01) |
| ***A63B 21/06*** | (2006.01) |
| ***A63B 21/072*** | (2006.01) |
| ***A63B 21/075*** | (2006.01) |

(52) U.S. Cl.

CPC ..... *A63B 23/03575* (2013.01); *A63B 21/015* (2013.01); *A63B 21/0602* (2013.01); *A63B 21/0603* (2013.01); *A63B 21/0608* (2013.01); *A63B 21/0724* (2013.01); *A63B 21/0728* (2013.01); *A63B 21/075* (2013.01)

USPC ..... 482/89; 482/50; 482/106

(58) Field of Classification Search

USPC ..... 482/104, 105, 108, 111, 49, 45, 110, 482/909; 220/719, 706; 215/306

See application file for complete search history.

(56) References Cited

U.S. PATENT DOCUMENTS

| | | | | |
|---|---|---|---|---|
| 3,747,593 | A * | 7/1973 | Taylor | 601/40 |
| 3,904,198 | A * | 9/1975 | Jones | 482/106 |
| 4,567,668 | A | 2/1986 | King et al. | |
| 5,037,087 | A * | 8/1991 | Roth | 482/93 |
| 5,178,597 | A | 1/1993 | Jones | |
| 5,244,445 | A * | 9/1993 | Amesquita | 482/110 |
| 5,364,325 | A | 11/1994 | Matthews | |
| 5,393,285 | A | 2/1995 | Fischer, Sr. et al. | |
| 5,445,587 | A | 8/1995 | Brown | |
| 5,509,877 | A | 4/1996 | Adams | |
| 5,509,880 | A | 4/1996 | Becker et al. | |
| 5,653,664 | A | 8/1997 | Jennings | |
| 5,857,946 | A | 1/1999 | Brown | |
| 5,876,312 | A | 3/1999 | McClendon | |
| 6,241,641 | B1 * | 6/2001 | Sawyer | 482/108 |
| D449,863 | S | 10/2001 | Kinde | |
| 6,379,286 | B1 | 4/2002 | Scopino et al. | |

(Continued)

FOREIGN PATENT DOCUMENTS

| | | |
|---|---|---|
| CN | 201519423 U | 7/2010 |
| DE | 29800445 U1 | 3/1998 |

(Continued)

*Primary Examiner* — Jerome w Donnelly

(74) *Attorney, Agent, or Firm* — Ferguson, Wacha & Kruse, LLC; Brenda J. Kruse

(57) ABSTRACT

An exercise device is disclosed having a main body including a material chamber formed therein. A flowable material is disposed within the material chamber and a level indicator is coupled to the main body. The exercise device is grasped by user. The flowable material and the level indicator provide sensory feedback to the user in respect of maintaining the exercise device in a substantially level position while in use.

19 Claims, 6 Drawing Sheets

(56) References Cited

U.S. PATENT DOCUMENTS

| | | | | |
|---|---|---|---|---|
| 6,403,137 | B1 * | 6/2002 | Frutin | 426/477 |
| 6,588,622 | B1 * | 7/2003 | Leishman et al. | 220/719 |
| 6,599,222 | B2 | 7/2003 | Wince | |
| 6,758,795 | B2 | 7/2004 | Barber | |
| 6,981,933 | B2 | 1/2006 | Scafidel | |
| 7,090,625 | B2 | 8/2006 | Chermack | |
| D544,554 | S | 6/2007 | Brun | |
| 7,364,536 | B2 | 4/2008 | Cappellini et al. | |
| 7,455,621 | B1 | 11/2008 | Anthony | |
| 7,563,216 | B1 | 7/2009 | Kest | |
| 7,749,145 | B2 | 7/2010 | Allen et al. | |
| 7,798,944 | B2 | 9/2010 | Suber, III et al. | |
| D633,155 | S | 2/2011 | Brun | |
| 8,038,585 | B1 | 10/2011 | Brown, Jr. | |
| 8,162,808 | B2 | 4/2012 | Cook | |
| 8,262,546 | B1 | 9/2012 | Lashinske et al. | |
| 2004/0063554 | A1 | 4/2004 | Wince | |
| 2007/0287600 | A1 | 12/2007 | Prenatt | |
| 2008/0312053 | A1 | 12/2008 | Kay | |
| 2009/0298606 | A1 | 12/2009 | Kim | |
| 2012/0129653 | A1 | 5/2012 | Shalev et al. | |
| 2012/0302409 | A1 | 11/2012 | Mikulski | |

FOREIGN PATENT DOCUMENTS

| | | | |
|---|---|---|---|
| DE | 202009017604 | U1 | 5/2010 |
| JP | 239763 | U | 3/1990 |
| JP | 2001145706 | A | 5/2001 |
| JP | 2002191717 | A | 7/2002 |
| WO | 02051505 | A2 | 7/2002 |

* cited by examiner

EXERCISE DEVICE

CROSS REFERENCE TO RELATED APPLICATIONS

This application is entitled to claim the benefit of, and claims priority to, U.S. provisional patent application Ser. No. 61/321,535 filed Apr. 7, 2010, the entire disclosure of which is incorporated herein by reference.

FIELD OF THE INVENTION

The invention relates to an exercise device and more particularly to an exercise device having a chamber formed therein for containing a flowable material.

BACKGROUND OF THE INVENTION

Exercise devices can be an important aid to individuals seeking to maintain and improve a level of physical fitness. One type of exercise device is often called a slosh pipe or a slosh tube. The slosh pipe includes a chamber formed therein. A flowable material such as water or sand, for example, is disposed within the chamber.

In use, a person uses legs or arms, for example, to raise and lower the slosh pipe while trying to maintain the slosh pipe in a level position to militate against a flow of the flowable material within the chamber. In the event the flowable material flows toward one of the ends of the slosh pipe while being raised or lowered, the person senses a change in the distribution of the flowable material through a change in the balance of the weight of the slosh pipe. The person must adjust movement in an attempt to return the exercise devise to a level position and restore the uniform distribution of the flowable material therein.

The slosh pipe may be employed to promote muscle coordination and overall balance of a user. Additionally, fine muscle control often needed to maintain the slosh pipe in a level position may provide targeted exercise of certain muscle groups that are not exercised or difficult to exercise employing traditional exercise devices such as free weights, dumbbells, and the like, for example.

Despite the potential benefits that exercise with the slosh pipe can provide, some individuals may forego the use of the slosh pipe due to a perceived or actual difficulty of using the slosh pipe. Further, the slosh pipe typically only provides tactile feedback to a user. Providing feedback to the user through other senses such as the sense of sight, for example, may provide additional fitness benefits and minimize the perceived or actual difficulty of exercising with the slosh pipe.

It would be desirable to produce an exercise device including a flowable material disposed therein, wherein tactile and visual feedback are provided to a user in respect of maintaining an even distribution of the flowable material while using the exercise device.

SUMMARY OF THE INVENTION

Concordant and consistent with the present invention, an exercise device including a flowable material disposed therein, wherein tactile and visual feedback are provided to a user in respect of maintaining an even distribution of the flowable material while using the exercise device, has surprisingly been discovered.

In one embodiment, an exercise device comprises: a main body including a material chamber formed therein, at least a portion of the main body configured to be grasped by a user; a flowable material disposed within the material chamber; and a level indicator coupled to the main body, wherein the flowable material and the level indicator provide sensory feedback to the user in respect of maintaining the exercise device in a substantially level position while in use.

In another embodiment, an exercise device comprises: a main body including a material chamber formed therein, the main body adapted to be grasped by a user; a weight plate releasably coupled to the main body; and a flowable material disposed within the material chamber, wherein the flowable material provides sensory feedback to the user in respect of maintaining the exercise device in a substantially level position while in use.

In yet another embodiment, an exercise device comprises: a main body including a material chamber formed therein; a flowable material disposed within the material chamber; and a first interface element receiving at least a portion of the main body therein to couple the first interface element to the main body, wherein the first interface element is at least one of directly and indirectly engaged by a user, and wherein the flowable material provides sensory feedback to the user in respect of maintaining the exercise device in a substantially level position while in use.

BRIEF DESCRIPTION OF THE DRAWINGS

The above advantages of the invention will become readily apparent to those skilled in the art from reading the following detailed description of an embodiment of the invention in the light of the accompanying drawings, in which.

DETAILED DESCRIPTION OF THE

Preferred Embodiment of the Invention

The following detailed description and appended drawings describe and illustrate various exemplary embodiments of the invention. The description and drawings serve to enable one skilled in the art to make and use the invention, and are not intended to limit the scope of the invention in any manner.

Figure 1:
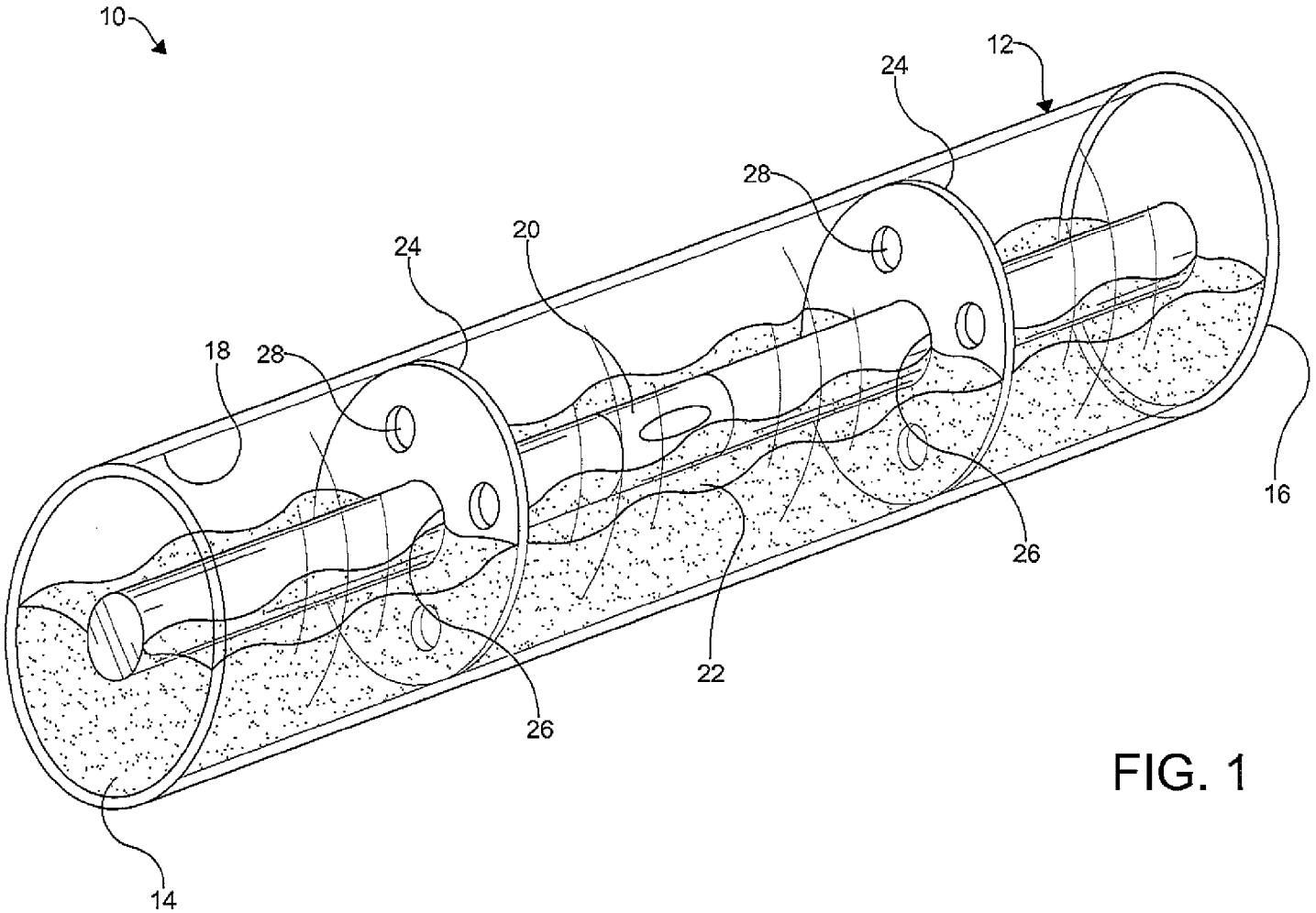
FIG. 1 is a perspective view of an exercise device according to an embodiment of the invention.

Referring now to FIG. 1, there is shown an exercise device 10 according to an embodiment of the invention. The exercise device 10 includes an elongate hollow main body 12 having end caps 14, 16 disposed on opposing ends thereof. In the illustrated embodiment the main body 12 is formed from a substantially transparent material. It should be understood that the main body 12 may be formed from translucent materials and opaque materials. The main body 12 and end caps 14, 16 form a substantially media tight material chamber 18 within the main body 12. It should be understood that the end caps 14, 16 can include a sealing member such as an O-ring, a flat gasket, and the like, for example. In the embodiment shown, at least one of the end caps 14, 16 is removably disposed on the main body 12 to provide an opening into the hollow interior of the main body 12. It should be understood that the main body 12 can be adapted to receive weight plates and the like thereon.

A level indicator 20 is disposed within the material chamber 18. In the illustrated embodiment, the level indicator 20 is an elongate spirit level, often referred to as a bubble level. Ends of the level indicator 20 are coupled to the respective end caps 14, 16 to position the level indicator 20 substantially co-axially with the main body 12. The level indicator 20 is visible through the substantially transparent main body 12. It should be understood that the level indicator 20 can be formed from an elongate support member having a level indicator such as a spirit level attached thereto. It should also be understood that the level indicator 20 can be coupled to the main body 12 on an inner surface or an outer surface thereof.

A flowable material 22 such as a fluid or a granular material, for example, is disposed within the material chamber 18. The flowable material 22 fills at least a portion of the material chamber 18, wherein the flowable material 22 can flow between the inner surface of the main body 12 and an outer surface of the level indicator 20 and the ends of the main body 12. It should be understood that a selected amount of the flowable material 22 can be disposed within the material chamber 18 to provide a selected total weight to the exercise device 10.

One or more baffles 24 may be disposed within the material chamber 18 to militate against a movement of the flowable material 22 within the material chamber 18 or dampen the movement thereof. In the illustrated embodiment, the baffles 24 are disk shaped members having a central opening 26, wherein the central opening of the disk receives the level indicator 20 to position the disk between the level indicator 20 and the inner surface of the fluid chamber 18 to reduce the flow area therebetween. The baffle 24 may include a plurality of openings 28 formed therein to allow the flowable material 22 to flow through the baffle 24. It should be understood that other baffles 24 can be used such as a fibrous material, for example. It should also be understood that the baffles 24 can be removed from or inserted into the material chamber 18 as desired to provide a desired level of flow resistance of the flowable material 22.

In use, one of the end caps 14, 16 is removed from the end of the main body 12 to provide access to the material chamber 18 formed therein. A selected quantity of the flowable material 22 is disposed within the material chamber 18. Typically, the material chamber 18 is partially filled with the flowable material 22 to allow the flowable material 22 to freely flow and slosh within the material chamber 18. One or more of the baffles 24 may be disposed within the material chamber 18 to restrict the flow and slosh of the flowable material 22. The one of the end caps 14, 16 is attached to the main body 12 to retain the flowable material 22 within the material chamber 18 and facilitate securing the level indicator 20 to the main body 12. It should be understood that weight plates can be attached to the main body 12 to cooperate with the flowable material 22 to provide a desired total weight for the exercise device 10.

A user grasps the main body 12 of the exercise device 10 with one or two hands and performs a selected exercise movement that causes a movement of the exercise device 10. The user attempts to maintain the exercise device 10 substantially level throughout the exercise movement to minimize a flow and sloshing of the flowable material 22 within the material chamber 18. In the event the level position is not maintained, the flowable material 22 will flow toward one of the ends of the material chamber 18 creating an uneven distribution of the flowable material 22 along a length of the exercise device 10. Tactile feedback is provided to the user as the uneven distribution of the flowable material 22 will be felt as an imbalance of the exercise device 10. Further, the exercise device 10 is positioned by the user so that the level indicator 20 can be viewed by the user while performing the exercise movement. The level indicator 20 provides a visual input to the user as to the level position of the exercise device 10. The user employs the tactile input provided by the flow of the flowable material 22 and the visual input provided by the level indicator 20 to coordinate body movement to maintain the exercise device 10 in a level position throughout the exercise movement. It should be understood that the baffles 24 may be employed by users that are not experienced performing exercise movements with the exercise device 10 to minimize the tactile feedback resulting from not maintaining the exercise device 10 in the level position. As a user improves an ability to maintain the level position of the exercise device 10, fewer or no baffles 24 may be employed to maximize the tactile feedback.

Figure 2:
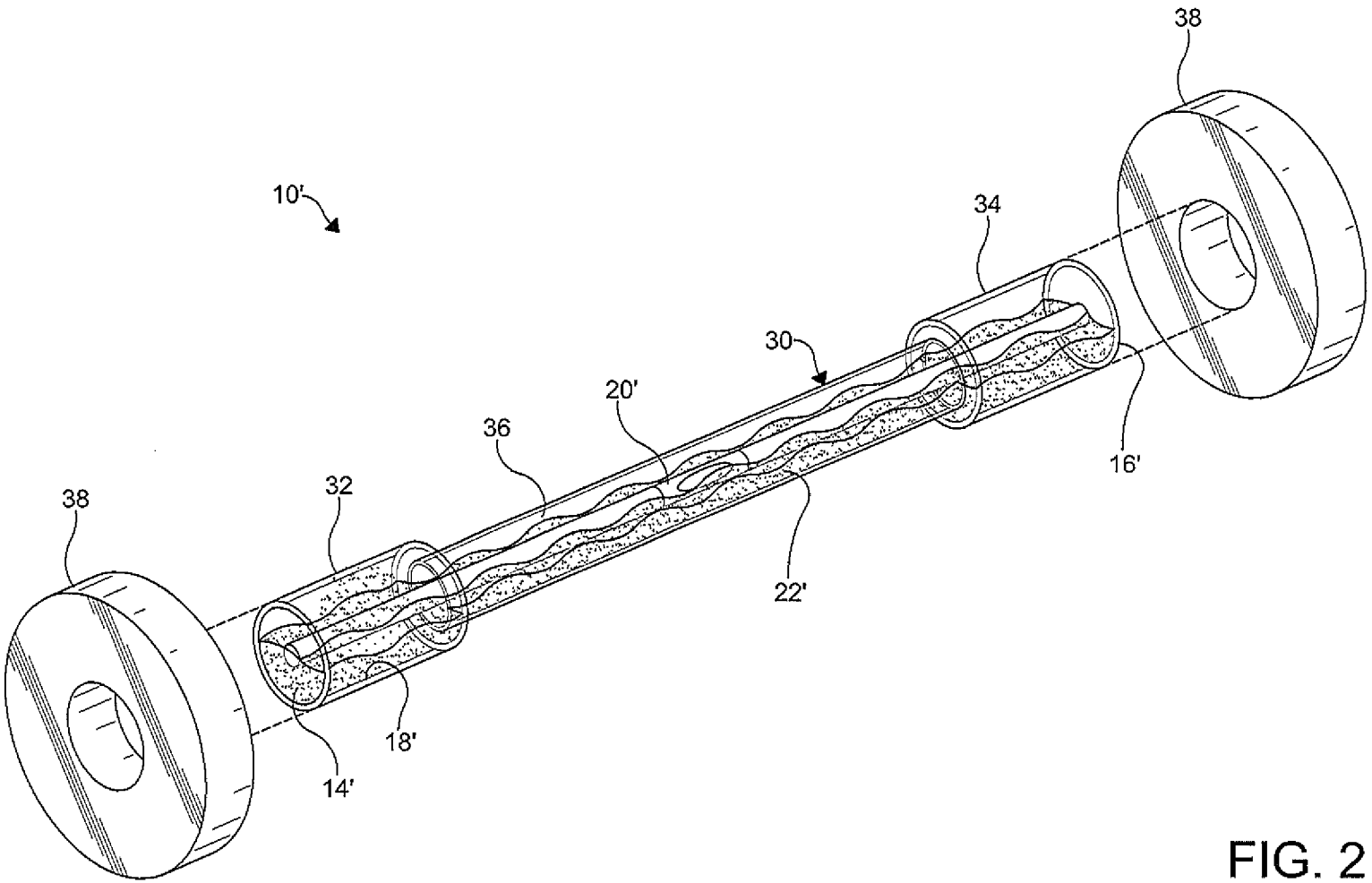
FIG. 2 is an exploded perspective view of an exercise device according to another embodiment of the invention.

FIG. 2 shows an alternate embodiment of the exercise device 10 shown in FIG. 1. Structure similar to that illustrated in FIG. 1 includes the same reference numeral and a prime (') symbol for clarity. In FIG. 2, an exercise device 10' is shown having an elongate hollow main body 30 including opposing ends 32, 34 and a central portion 36 between the ends 32, 34. End caps 14', 16' are disposed on the respective ends 32, 34 of the main body 30. A diameter of the central portion 36 of the main body 30 is smaller than a diameter of the ends 32, 34 to facilitate a user grasping the central portion 36 of the main body 30. The ends 32, 34 can be adapted to receive weight plates 38 and the like thereon. It should be understood that the weight plates 38 can be substantially secured to the ends 32, 34 employing an interference fit or a retaining collar, as is commonly known in the art. Further, a thread can be formed in each of the ends 32, 34 to facilitate receiving the weight plates 38 or the retaining collar. One or more baffles (not shown) can be disposed within the material chamber 18'. The remaining structure and use of the exercise device 10' is substantially the same as the structure and use of the exercise device 10 shown in FIG. 1 and described herein above.

Figure 3:
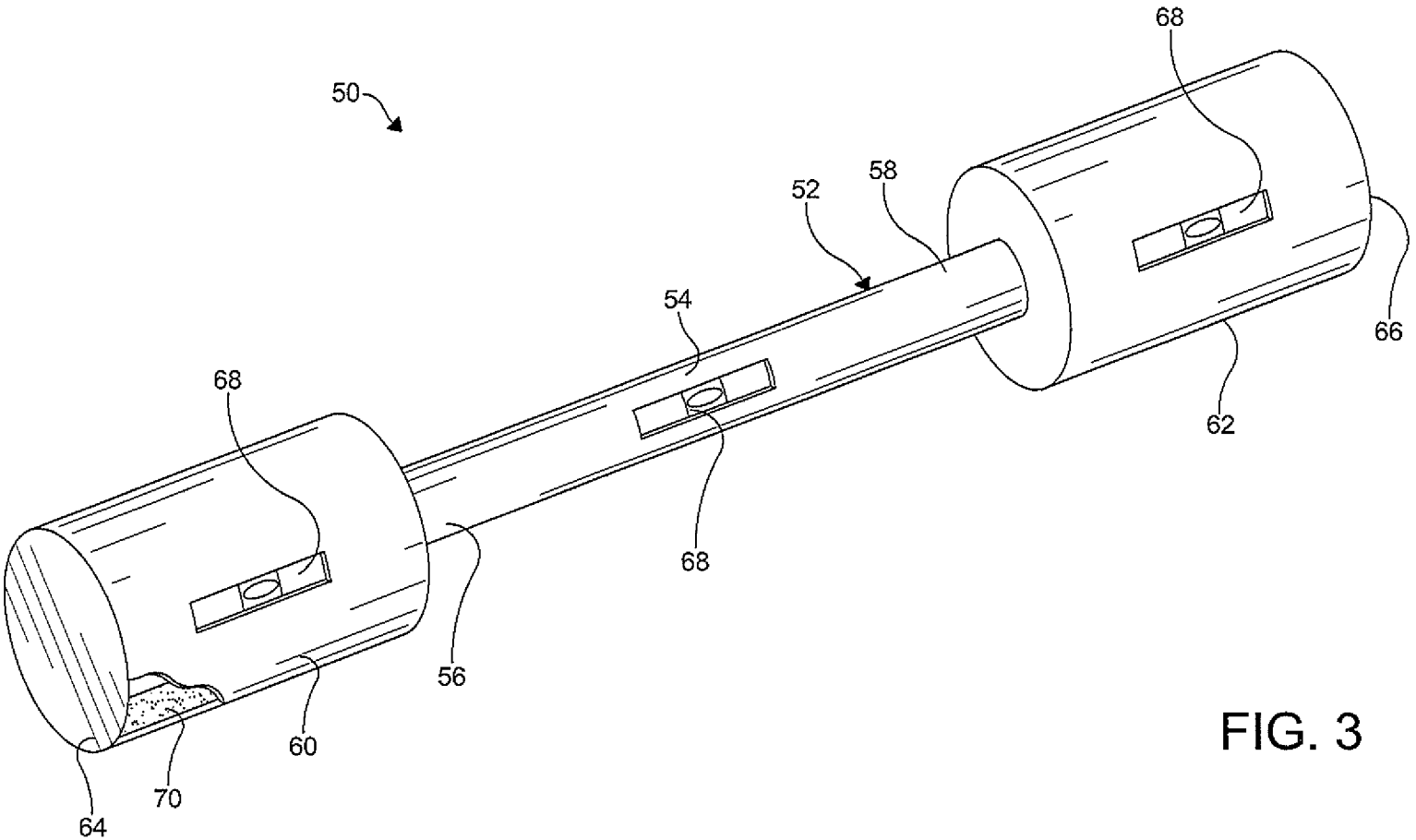
FIG. 3 is a perspective view of an exercise device according to another embodiment of the invention, having a portion thereof cutaway.

In FIG. 3, an exercise device 50 is illustrated showing another embodiment of the invention. The exercise device 50 includes a main body 52 including a bar 54 having opposing ends 56, 58. A pair of hollow substantially media tight material chambers 60, 62 is disposed on the ends 56, 58, respectively, of the bar 54. In the illustrated embodiment, the bar 54 is substantially straight. It should be understood that the bar 54 can include bends and curved portions such as an exercise bar commonly known as an E-Z curl bar, for example. It should also be understood that the material chambers 60, 62 may be removably disposed on the ends 56, 58 to allow for the use of different sized and shaped material chambers 60, 62. Further, the material chambers 60, 62 can be adapted to receive weight plates and the like thereon. The material chambers 60, 62 include end caps 64, 66, respectively, disposed on an end thereof. The end caps 64, 66 are removably disposed on the material chambers 60, 62 to provide an opening into the hollow interior thereof. The end caps 64, 66 facilitate forming a substantially media tight seal between the material chambers 60, 62 and the end caps 64, 66. It should be understood that the end caps 64, 66 can include a sealing member such as an O-ring, a flat gasket, and the like, for example.

Level indicators 68 are provided on an exterior surface of the bar 54 and an exterior surface of the material chambers 60, 62. It should be understood that a single level indicator 68 can be used and attached to one of the bar 54 and the material chambers 60, 62. Further, the level indicators 68 can be disposed in the bar 54 and the material chambers 60, 62 such as within a countersink and a cavity formed therein, for example.

A flowable material 70 such as a fluid or a granular material, for example, is disposed within the material chambers 60, 62. The flowable material 70 fills at least a portion of the material chambers 60, 62, wherein the flowable material 70 can flow and slosh therein. It should be understood that a selected amount of the flowable material 70 can be disposed within the material chambers 60, 62 to provide a selected total weight to the exercise device 50. One or more baffles (not shown) can be disposed within the material chamber 60, 62 to restrict the flow and sloshing of the flowable material 70 therein.

The remaining structure and use of the exercise device 50 is substantially the same as the structure and use of the exercise device 10 shown in FIG. 1 and described hereinabove.

Figure 4:
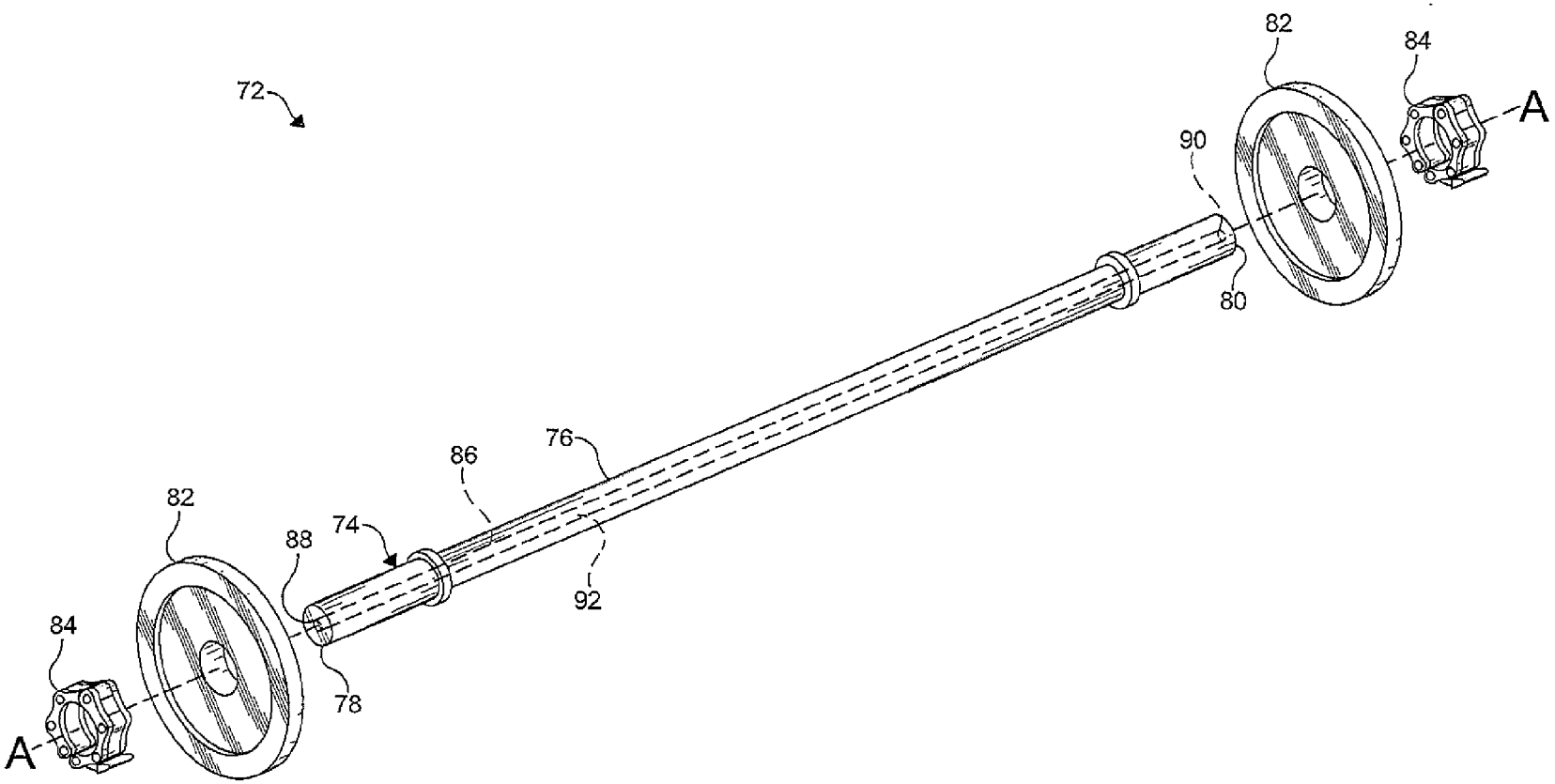
FIG. 4 is an exploded perspective view of an exercise device according to another embodiment of the invention.

In FIG. 4, an exercise device 72 is illustrated showing another embodiment of the invention. The exercise device 72 includes a main body 74 including a bar 76 having opposing ends 78, 80. As a non-limiting example, the bar 76 is similar in size and shape to a conventional Olympic barbell. However, it is understood that the bar 76 can have any shape and size. Further, the bar 76 can be adapted to receive a plurality of weight plates 82 and locking collars 84 as appreciated by one skilled in the art.

A substantially media tight material chamber 86 is substantially centrally formed along a longitudinal axis A-A of the bar 76. In the illustrated embodiment, the bar 76 and the material chamber 86 are substantially straight. It should be understood that the bar can include bends and curved portions such as an exercise bar commonly known as an E-Z curl bar, for example. The bar 76 typically includes end caps 88, 90, disposed on opposing ends thereof. The end caps 88, 90 are removably disposed on the bar 76 to provide an opening into the material chamber 86. The end caps 88, 90 facilitate forming a substantially media tight seal between the bar 76 and the end caps 88, 90. It should be understood that the end caps 88, 90 can include a sealing member such as an O-ring, a flat gasket, and the like, for example. It is further understood that the material chamber 86 can be sealed using other means. In certain embodiments, a level indicator (not shown) is coupled to an exterior surface of the bar 76.

A flowable material 92 such as a fluid or a granular material, for example, is disposed within the material chamber 86. The flowable material 92 fills at least a portion of the material chamber 86, wherein the flowable material 92 can flow and slosh therein. It should be understood that a selected amount of the flowable material 92 can be disposed within the material chamber 86 to provide a selected total weight to the exercise device 72. One or more baffles (not shown) can be disposed within the material chamber 86 to restrict the flow and sloshing of the flowable material 92 therein.

The remaining structure and use of the exercise device 72 is substantially the same as the structure and use of the exercise device 10 shown in FIG. 1 and described herein above.

Figure 5:
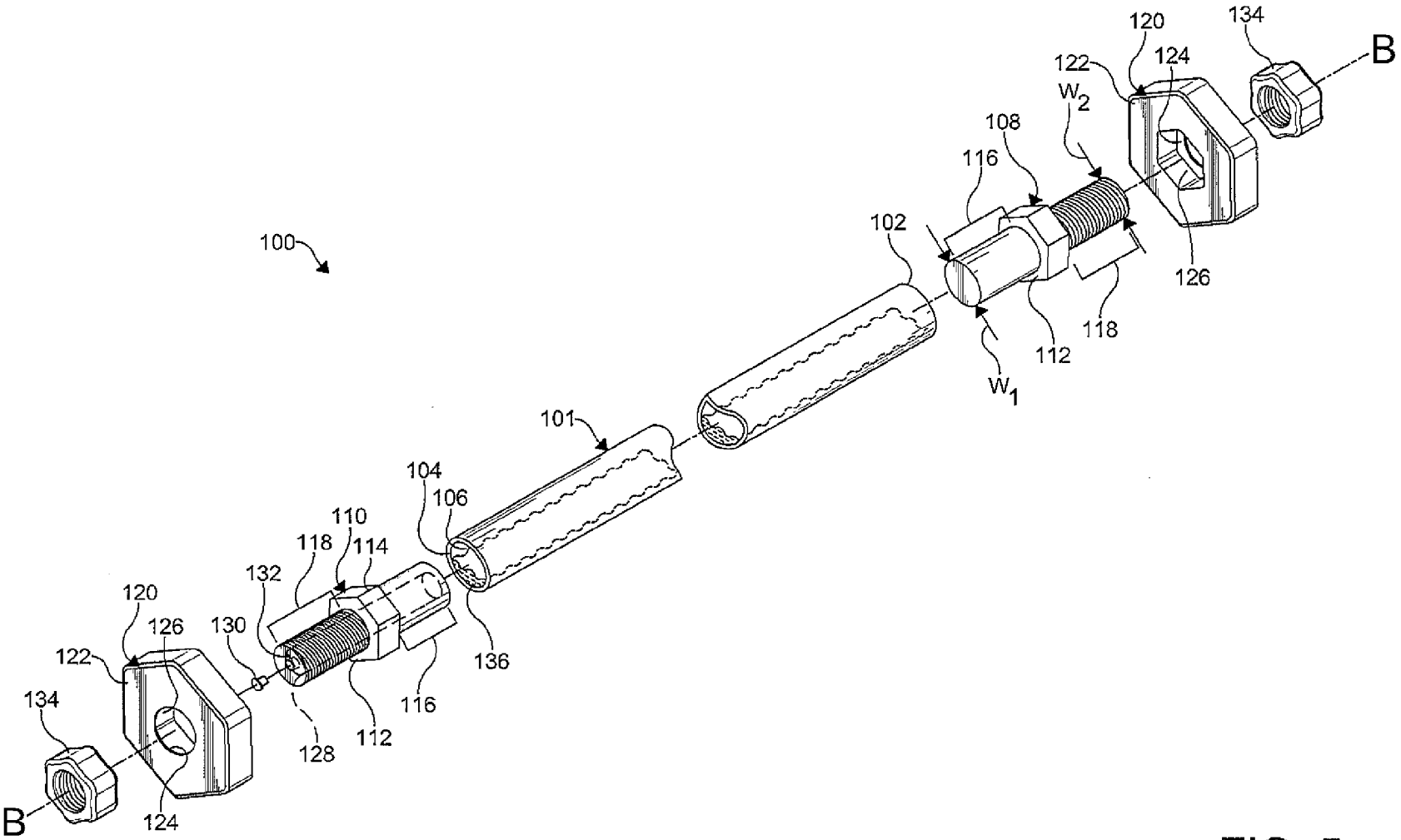
FIG. 5 is an exploded perspective view of an exercise device according to another embodiment of the invention.

In FIG. 5, an exercise device 100 is illustrated showing another embodiment of the invention. The exercise device 100 includes a main body 101 having opposing ends 102, 104. As a non-limiting example, the main body 101 is a hollow tube. However, it is understood that the main body 101 can have any shape and size. Further, the main body 101 can be adapted to receive a plurality of weight plates (not shown) as appreciated by one skilled in the art.

A substantially media tight material chamber 106 is substantially centrally formed along a longitudinal axis B-B of the main body 101. In the illustrated embodiment, the main body 101 and the material chamber 106 are substantially linear. It should be understood that the main body 101 can include bends and curved portions, for example. The main body 101 typically includes end caps 108, 110 or inserts disposed in/on the opposing ends 102, 104 thereof. At least one of the end caps 108, 110 is removably disposed in the main body 101 to facilitate forming a substantially media tight seal between the main body 101 and the at least one of the end caps 108, 110. It should be understood that the end caps 108, 110 can include a sealing member such as an O-ring, a flat gasket, and the like, for example.

In the embodiment shown, each of the end caps 108, 110 includes a main body 112 having an integral hub 114 circumferentially disposed around the main body 112 and extending radially outwardly therefrom. As a non-limiting example, the integral hub 114 is disposed intermediate opposing ends of the respective main body 112 of each of the end caps 108, 110. As a further non-limiting example, the integral hubs 114 have a generally hexagonal shape. However, the integral hubs 114 can have any size and shape, as desired.

In certain embodiments, the main body 112 (e.g. formed polyvinyl chloride) of each of the end caps 108, 110 includes an interior portion 116 and an exterior portion 118 extending axially outwardly in generally opposing directions from the integral hub 114. As a non-limiting example, each of the interior portion 116 and the exterior portion 118 has a substantially cylindrical shape. As a further non-limiting example, the interior portion 116 has a radial width W1 (e.g. a circumference) that is greater than a radial width W2 (e.g. a circumference) of the exterior portion 118. However, the interior portion 116 and the exterior portion 118 can have any size and shape relative to each other.

In certain embodiments, an outer hub 120 is disposed adjacent the integral hub 114 of the main body 112 of each of the end caps 108, 110. Specifically, the outer hubs 120 include a main body 122 having an aperture 124 formed therein and a recessed portion 126 circumferentially formed adjacent the aperture 124. As a non-limiting example, the aperture 124 is generally circular to receive the exterior portion 118 of an associated one of the end caps 108, 110. As a further non-limiting example, the recessed portion 126 has a shape (e.g. generally hexagonal) to receive the integral hub 114 of one of the end caps 108, 110 and thereby secure the outer hub 120 to the integral 114. It is understood that the outer hubs 120 can be bonded to the integral hubs 114. It is further understood that the outer hubs 120 can be formed from polyurethane to optimize a bonding with the integral hubs 114. However, other materials can be used.

In the embodiment shown, at least one of the end caps 108, 110 includes a channel 128 formed therethrough to allow a flowable material to pass therethrough. As a non-limiting example, a plug 130 is removeably received in an end of the channel 128 to provide a fluid tight seal and to militate against a fluid passing through the channel 128. As a further non-limiting example, a port 132 or purge hole is in fluid communication with the channel 128 to allow air from the material chamber 106 to pass therethrough, as understood in the art.

In certain embodiments, the exterior portions 118 of each of the end caps 108, 110 are adapted to receive a retaining element 134 or collar. As a non-limiting example, the exterior portions 118 are threaded to threadably engage the retaining element 134 to militate against undesired movement of the retaining element 134 relative to the end caps 108, 110. As a further non-limiting example, a plurality of weight plates (not shown) can be releasably disposed around the exterior portion 118 of the end caps 108, 110 and adjacent the integral hub 114. Accordingly, the retaining element 134 can be positioned to secure the weight plates against the integral hub 114. It is understood when the outer hub is disposed adjacent the integral hub 114, the weight plates are disposed adjacent the outer hub 120 and secure against the outer hub 120.

A flowable material 136 such as a fluid or a granular material, for example, is disposed within the material chamber 106. The flowable material 136 fills at least a portion of the material chamber 106, wherein the flowable material 136 can flow and slosh therein.

In use, the interior portions 114 of each of the end caps 108, 110 are inserted into the opposing ends 102, 104 of the main body 102. In the embodiment shown, the first end cap 102 is solid and effectively seals the first end 102 of the main body 101, while the second end cap 104 includes the channel 128 to allow the flowable material 136 to be exchanged with the material chamber 106. When the end caps 108, 110 are in position, the integral hubs 114 abut the main body 101. The outer hubs 120 are disposed adjacent the integral hubs 114 and secured in position by the retaining elements 134. It is understood that any number of weight plates can be positioned between the retaining elements 134 and the outer hubs 120. It is further understood that gaskets or O-rings can be positioned between the retaining elements 134 and the outer hubs 120 to provide a friction therebetween to militate against an undesired relative rotation. Once assembled, the material chamber 106 of the exercise device 100 can be filled with the flowable material 136. It should be understood that a selected amount of the flowable material 136 can be disposed within the material chamber 106 to provide a selected total weight to the exercise device 100. One or more baffles (not shown) can be disposed within the material chamber 106 to restrict the flow and sloshing of the flowable material 136 therein.

Figure 6:
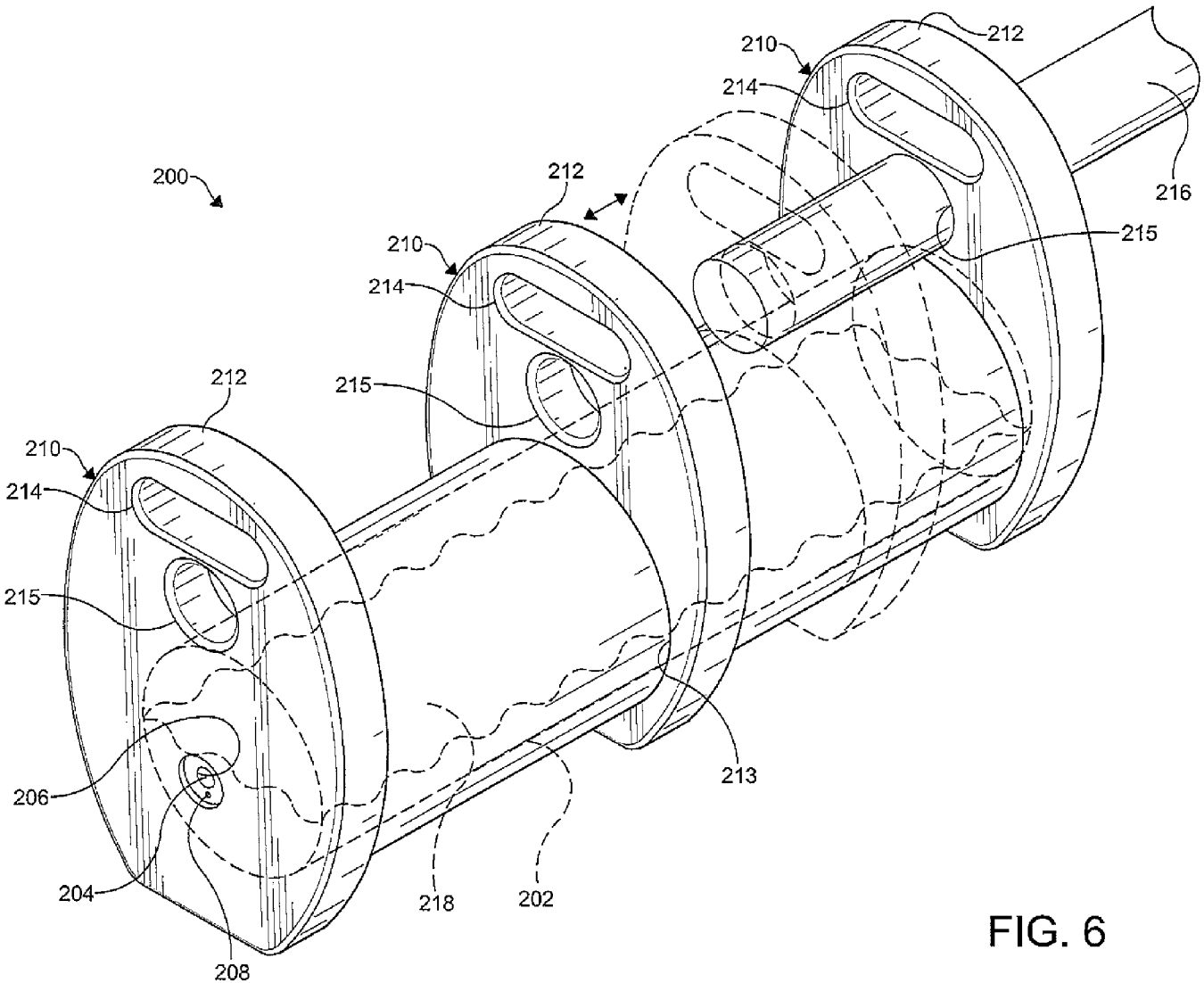
FIG. 6 is a perspective view of an exercise device according to yet another embodiment of the invention.

In FIG. 6, an exercise device 200 is illustrated showing another embodiment of the invention. The exercise device 200 includes a main body 200 having a substantially media tight material chamber 202 formed therein. As a non-limiting example, the material chamber 202 is substantially centrally formed along a longitudinal axis C-C of the main body 200. In the illustrated embodiment, the main body 200 has a generally cylindrical shape and the material chamber 202 is substantially straight. It should be understood that the bar can include bends and curved portions, for example. As a non-limiting example, a plug 204 is removeably received in an opening 206 formed in the main body 200 to selectively allow a fluid to pass into/out of the material chamber 202. As a further non-limiting example, a port 208 or purge hole is in fluid communication with the material chamber 202 to allow air from the material chamber 202 to pass therethrough during a filling operation, as understood in the art.

In the embodiment shown, a plurality of interface elements 210 are coupled to the main body 200 to allow a user to directly and/or indirectly engage the exercise device 200 to execute a lifting and/or a lateral motion. As a non-limiting example, each of the interface elements 210 includes a main body 212 receiving at least a portion of the main body 200 therethrough to facilitate coupling the main body 200 to the interface elements 210. In certain embodiments, at least one of the interface elements 210 includes an aperture 213 formed therethrough to receive the main body 200 to slidably couple the main body 200 to the at least one of the interface elements 210. It is understood that the slidable engagement between the at least one of the interface elements 210 and the main body 200 allows adjustment of a spacing between the at least one of the interface elements 210 and the other of the interface elements 210. In the embodiment shown, a pair of the interface elements 210 is fixedly disposed adjacent opposing ends of the main body 200 and another of the interface elements 210 is slidably coupled to the main body 200 intermediate the pair of the interface elements 210.

As a non-limiting example, each of the interface elements 210 includes a handle portion 214 and a through-hole 215. As shown, the handle portions 214 provide a means for a user to grasp the interface elements 210 to lift or move the exercise device 200. It is understood that the size, shape, and position of the handle portions 214 can be varied. The through-holes 215 are shown interposed between the handle portions 214 of the respective interface element 210 and the main body 200. As a non-limiting example, the through-holes 215 are sized to receive at least a portion of a conventional barbell 216 therethrough to coupled the exercise device 200 to the barbell 216 in a manner consistent with a conventional weight plate. For this purpose, the at least one of the interface elements 210 that is slidably coupled to the main body 200 can be positioned to facilitate a secure coupling of the exercise device 200 and the barbell 216.

A flowable material 218 such as a fluid or a granular material, for example, is disposed within the material chamber 202. The flowable material 218 fills at least a portion of the material chamber 202, wherein the flowable material 218 can flow and slosh therein. It should be understood that a selected amount of the flowable material 218 can be disposed within the material chamber 202 to provide a selected total weight to the exercise device 200. One or more baffles (not shown) can be disposed within the material chamber 202 to restrict the flow and sloshing of the flowable material 218 therein.

In use, the exercise device 200 can be directly (e.g. via the handle portions 212) and/or indirectly (e.g. via the barbell 216 coupled to the exercise device 200) engaged by a user. Accordingly, the flowable material 218 provides sensory feedback to the user in respect of maintaining the exercise device 200 in a substantially level position while in use.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An exercise device comprising:

a main body including a first end, a second end, and a material chamber formed therein, at least a portion of the main body configured to be grasped by a user, wherein at least one of the first end and the second end of the main body is configured to releasably receive at least one weight plate thereon; and a flowable material disposed within the material chamber.

2. The exercise device according to claim 1, further comprising an end cap coupled to the main body to selectively seal the material chamber.

3. The exercise device according to claim 1, wherein the main body is substantially transparent to allow the user to view the flowable material disposed within the material chamber.

4. The exercise device according to claim 1, wherein the material chamber extends along substantially an entire length of the main body.

5. The exercise device according to claim 1, further comprising a level indicator coupled to the main body, wherein the level indicator is disposed substantially coaxially with the main body.

6. The exercise device according to claim 5, wherein the level indicator is a spirit level.

7. The exercise device according to claim 1, further comprising a baffle disposed within the material chamber to militate against movement of the flowable material.

8. The exercise device according to claim 7, wherein the baffles include at least one opening formed therein to allow the flowable material to pass therethrough.

9. An exercise device comprising:

a main body including a material chamber formed therein, the main body adapted to be grasped by a user;

an end cap having an interior portion disposed within the main body and an exterior portion extending axially outwardly from the main body;

a weight plate releasably coupled to the main body; and a flowable material disposed within the material chamber, wherein the flowable material provides sensory feedback to the user in respect of maintaining the exercise device in a substantially level position while in use.

10. The exercise device according to claim 9, further comprising an end cap coupled to the main body to selectively seal the material chamber.

11. The exercise device according to claim 9, wherein the main body is substantially transparent to allow the user to view the flowable material disposed within the material chamber.

12. The exercise device according to claim 9, wherein the material chamber extends along substantially an entire length of the main body.

13. The exercise device according to claim 9, further comprising a level indicator coupled to the main body to provide a sensory feedback to the user in respect of maintaining the exercise device in a substantially level position while in use.

14. The exercise device according to claim 9, wherein the exterior portion is threaded and configured to receive a retaining element, and wherein the weight plate is releasably coupled to the end cap.

15. The exercise device according to claim 9, further comprising a hub circumferentially disposed adjacent the end cap intermediate opposing ends of the main body and extending generally radially outwardly therefrom.

16. An exercise device comprising:

a main body including a material chamber formed therein;

a flowable material disposed within the material chamber; and at least one rigid baffle disposed within the material chamber to restrict a movement of the flowable material.

17. The exercise device according to claim 16, further comprising a first interface element receiving at least a portion of the main body therein to couple the first interface element to the main body, wherein the first interface element is at least one of directly and indirectly engaged by a user.

18. The exercise device of claim 17 wherein the first user interface includes a through-hole to receive at least a portion of a barbell therethrough to thereby couple the exercise device to the barbell.

19. The exercise device according to claim 17, further comprising a second interface element slidably coupled to the main body to adjust a spacing between the second interface element and the first interface element.

* * * * *